US005916005A

United States Patent [19]

Baik et al.

[11] Patent Number: 5,916,005

[45] Date of Patent: Jun. 29, 1999

[54] HIGH CURVATURE DIAMOND FIELD EMITTER TIP FABRICATION METHOD

[75] Inventors: Young-Joon Baik; Kwang Yong Eun, both of Seoul, Rep. of Korea

[73] Assignee: Korea Institute of Science and Technology, Seoul, Rep. of Korea

[21] Appl. No.: 08/791,872

[22] Filed: Jan. 31, 1997

[30] Foreign Application Priority Data

Feb. 1, 1996 [KR] Rep. of Korea ..... 96-2455

[51] Int. Cl.[6] ..... H01J 9/02; H01J 1/30

[52] U.S. Cl. ..... 445/51; 445/50; 313/311

[58] Field of Search ..... 445/50, 51; 313/311

[56] References Cited

U.S. PATENT DOCUMENTS

| | | | |
|---|---|---|---|
| 5,138,237 | 8/1992 | Kane et al. | 313/311 X |
| 5,289,086 | 2/1994 | Kane | 313/311 X |
| 5,551,903 | 9/1996 | Kumar et al. | 445/24 |
| 5,578,901 | 11/1996 | Blanchet-Fincher et al. | 313/309 X |

OTHER PUBLICATIONS

Young–Joon Baik, et al., 2nd International Conference on the Applications of Diamond Films and Related Materials, "Effect of Growth Plane Index of Polycrystalline Diamond Film on Raman Spectrum" (1993) pp. 709–714.

Young–Joon Baik, et al., Thin Solid Films, "Texture Formation of Diamond Film Synthesized in the C–H–O System", (1992), pp. 123–131.

Young–Joon Baik, et al., Thin Solid Films, "Habit Modification of Gas Phase Synthesized Diamond Particles in the C–H–O System", (1992), pp. 156–163.

A.A. Morrish, et al., Appl. Phys. Lett., "Effects of Surface Pretreatments on Nucelation and Growth of Diamond Films on a Variety of Substrates", (1991), pp. 417–419.

S. Yugo, et al., Vacuum, "Effects of Electric Field on the Growth of Diamond by Microwave Plasma CVD", (1990), pp. 1364–1367.

W.P. Kang, et al., Application of Diamond Films and Related Materials: Third International Conference, (1995), pp. 37–40.

C.A. Spindt, IEEE Transactions on Electron Devices, "File-d–Emitter Arrays for Vacuum Microelectronics", (1991), pp. 2355–2363.

B.B. Pate, Surface Science, "The Diamond Surface: Atomic and Electronic Structure", (1986), pp. 83–142.

N.S. Xu, et al., J. Phys. D: Appl. Phys., "Similarities in the 'Cold' Electron Emission Characteristics of Diamond Coated Molybdenum Electrodes and Polished Bulk Graphite Surface", (1993), pp. 1776–1780.

V.V. Zhirnov, et al., J. Vac. Sci Technol. B, "Field Emission from Silicon Spikes with Diamond Coatings", (1995), pp. 418–421.

*Primary Examiner*—Kenneth J. Ramsey
*Attorney, Agent, or Firm*—Scully, Scott, Murphy & Presser

[57] ABSTRACT

A high curvature diamond field emitter tip fabrication method includes forming on a substrate a diamond film composed of square (100) phase-oriented facets and (111) phase-oriented facets distributed thereabout and columnar diamond particles having defect density differences between the diamond formed beneath the (100) and (111) diamond growth facets, and etching the diamond film using a oxygen-containing gas plasma. Further, the method includes forming on a substrate a diamond film composed of square (100) facets and (111) facets distributed thereabout and columnar diamond particles having defect density differences between the diamond formed beneath the (100) and (111) diamond growth facets, forming a supporting film on the diamond film, removing the substrate therefrom, and etching the diamond film using an oxygen-containing gas plasma after any one of the previously described steps.

7 Claims, 4 Drawing Sheets

DEPOSITION OF DRAMOND FILM

DEPOSITION OF SiC FILM

EACHING SUBSTRATE

EACHING DIAMOND

HIGH CURVATURE DIAMOND FIELD EMITTER TIP FABRICATION METHOD

BACKGROUND OF THE INVENTION

1. Field on the Invention

The present invention relates to an electric field emitter tip, for a field emission display (FED) device and more particularly to a high curvature diamond field emitter tip fabrication method.

2. Brief Description of the Conventional Art

Electron emission occurring from a solid facet due to an applied electrical field is a physical property which is utilized for the implementation of electronic displays such as a field emitting display (FED) which is a flat panel type displays, and is implemented as a vacuum microelectronics device. A very basic requirement in such an application is to secure a high quality field emitter capable of emitting electrons when an electrical field is applied. Characteristics required for an improved field emitter include facilitated electron emission, an increased electron emission, and enhanced durability.

Recent studies on electric field emitter development have followed two directions. One proposal involves inducing electron emission by concentrating the electrical field on a tip unit having a geometrically high curvature. The other proposal involves employing as an emitter a material having a low work function value which is essential for electrons to escape from a solid phase.

In the case of the former proposal, a tip having pointed top portions has been formed using materials such as Si and Mo by means of a dry etching process or a specialized deposition, and its electron emission effect has been confirmed and studies are being made as to how to apply the effect to a field emission display, as reported in H. F. Gray, Proc. 29th. Int. Field Emission Symp., 111 (1982), C. A. Spindt, C. E. Holland, A. Rosengreen and I. Brodie, IEEE. Trans. on Electron Devices, 38, 2355(1991).

In the latter proposal, there are reported study results concerning a variety of materials. Among the materials, diamond shows the most promise, because the use of diamond decreases significantly the degradation occurring when used as a field emitter due to its outstanding mechanical, thermal and radiation-proof properties, as well as showing a negative electron affinity, as reported in B. B. Pate, Surf. Science, 165, 83(1986). The negative electron affinity characteristic of diamond provides advantages such as a simplified process in which diamond is formed into a plate type emitter instead of a tip type, and increased durability.

Since diamond has a negative electron affinity characteristic, a diamond formed into a plate shape is still expected to emit electrons therefrom. However, when tips are formed geographically and the electrical field concentration effect is supplemented, increased electron emission under much lower applied voltage can be expected.

Towards such objectives, a variety of trials are being made, one of which, for example is to coat diamond into a film on a Si or Mo tip which has been developed as a conventional field emitter, as reported in N. S. Xu, Y. Tzeng and R. V. Latham, J. Phys. D26, 1776 (1993), V. V. Zhirnov, E. I. Givargizov and P. S. Plenkhanov, J. Vac, Sci. and Tech., B13(2), (1995). However, the fabrication method as tried in the above-described example exhibits disadvantages in that without a special spreading process being performed on the substrate surface prior to diamond deposition, the low density diamond nucleus being deposited therein it remains difficult to achieve uniform diamond film deposition thereon, as reported in A. A. Mosish and P. E. Pehrsson, Appl. Phys. Lett., 59, 417 (1991), and due to Si tip weakness it is also difficult to coat a uniform diamond film on the tips using the conventional spreading processing.

According to S. Yugo, T. Kimura and T. Muto, Vacuum, 41, 1364 (1990), a bias enhanced nucleation method for improving nucleus density by applying within a plasma, a direct voltage to a substrate has been introduced, but still encounters difficulties in forming a tantamount nucleus.

Additionally, according to W. P. Kang, J. L. Davidson, Q. Li, D. L. Kinser and D. V. Kerns, 3rd Int. Conf. on Appl. of Diamond Films and Related Materials, ed. by A. Feldman et al., NIST Washington D.C., p.37 (1995), recent studies on forming a diamond thin film directly into a tip are also being performed, which method includes forming an Si substrate having tip type incisions therein, depositing diamond in the incisions, detaching the Si substrate therefrom, and forming an embossed type diamond tip thereon. The diamond tip formed as described above exhibits a better field emission property compared to that of a plate type diamond film, however, the above-described diamond tip fabrication method shows limits in controlling its curvature, since the diamond tip curvature is controlled by the Si etching degree. Besides, the complicated fabrication process triggers further difficulties in forming a field emitter array.

DETAILED DESCRIPTION OF THE PREFERRED EMBODIMENTS

Accordingly, it is an object of the present invention to provide an improved fabrication method for diamond tips having high apex curvatures by employing an anisotropical etching property of a diamond film in accordance with a columnar texture formation mechanism and a growth phase crystal defect difference as observed in the article, Y. J. Baik, K. Y. Eun and A. Badzian, 2nd Int. Conf. on Appl. of Diamond Films and Related Materials, ed. by M. Yoshikawa et al., MYU, Tokyo, Japan, p709, 1993.

A diamond film is known to grow in a columnar texture, to form a diamond-particled texture having a certain orientation in accordance with a deposition level, to vary a diamond film growth phase type according to each texture orientation, and to differentiate crystal facets and composite rate of growth facet, reference to: Y. J. Baik and K. Y. Eun, Thin Solid Films, 214, 123, 1992; Y. J. Baik, K. Y. Eun and A. Badzian, 2nd Int. Conf. on Appl. of Diamond Films and Related Materials, Tokyo, Japan, p.709, 1993.

The pointed diamond tip fabrication method in accordance with the present invention includes forming on a substrate a diamond film composed respectively of a diamond columnar particle and a (100) oriented square phase having different stacking faults between solids formed behind a (100) diamond surface and a (111) diamond surface, and etching the diamond film by using an oxygen-containing plasma.

There are no particular limits in selecting the substrate on which the diamond film is formed. Any material such as Si or Mo which can be easily detached from a certain film deposited thereon by employing a general chemical method may be used for a substrate in accordance with the diamond tip fabrication conditions or the usage of a manufactured diamond tip.

Figure 1A:
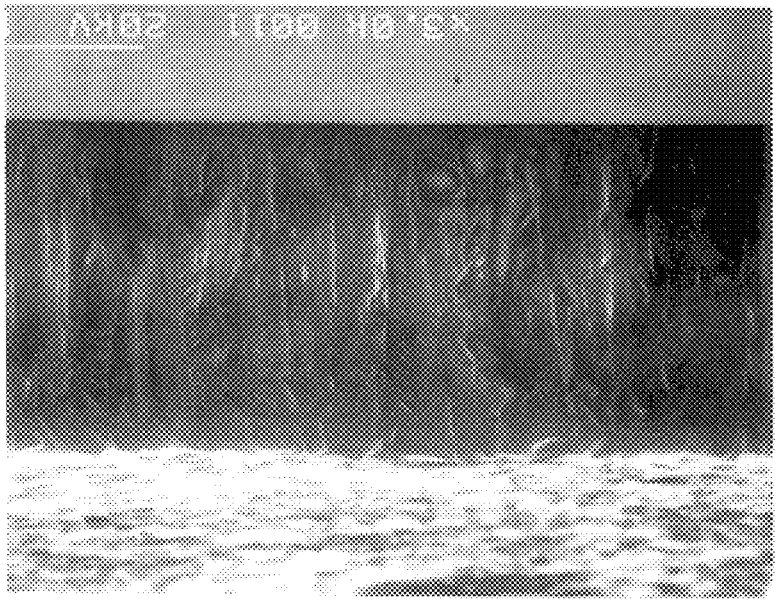
FIG. 1A is a micrographic view showing a (100) phase oriented diamond film surface texture.

A diamond film formed of columnar particles and having different diamond fault densities with regard to (100) and (111) diamond facets can be fabricated using widely known methods, which diamond film is composed of (100) square facets and (111) facets thereabout, as shown in FIG. 1A. Such fabrication may be obtained by introducing a factor which can transform diamond film surface lattice structure by means of adopting a diamond texture formation mechanism, refer to Y. J. Baik and K. Y. Eun, Thin Solid Films, 212, 156 (1992). The above-described diamond film can be fabricated by changing the diamond deposition temperature, adding a different gas such as oxygen during the diamond deposition, or increasing the methane concentration therein, which diamond fabrication methods are presented in a Korean Patent Application No. 92-22104.

Figure 1B:
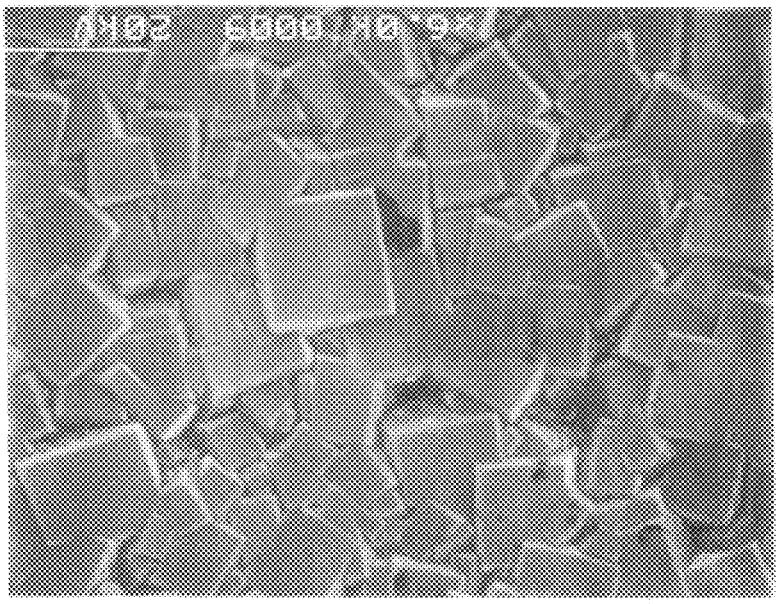
FIG. 1B is a cross-sectional micrographic view showing a (100) phase oriented diamond film texture.

FIGS. 1A and 1B respectively show a diamond film surface texture and a diamond film cross-sectional texture thereof which are obtained under conditions similar to those for a (100) oriented texture. The typical film surface in accordance with the present invention consists of (100) square facets and (111) facets distributed thereabout. A diamond film grows in (100) and (111) facets, and the diamond film's property behind each growth facet depends upon those growth facets. The diamond film according to the present invention shows different defect densities between (100) facet growth diamond and (111) facet growth diamond. That is to say, the diamond defect density formed behind a (100) facet is much smaller than that formed behind a (111) facet, so that (111) facet growth diamond is etched much better. Those defect density differences can be easily confirmed by micro Raman diamond analysis.

Figure 2:
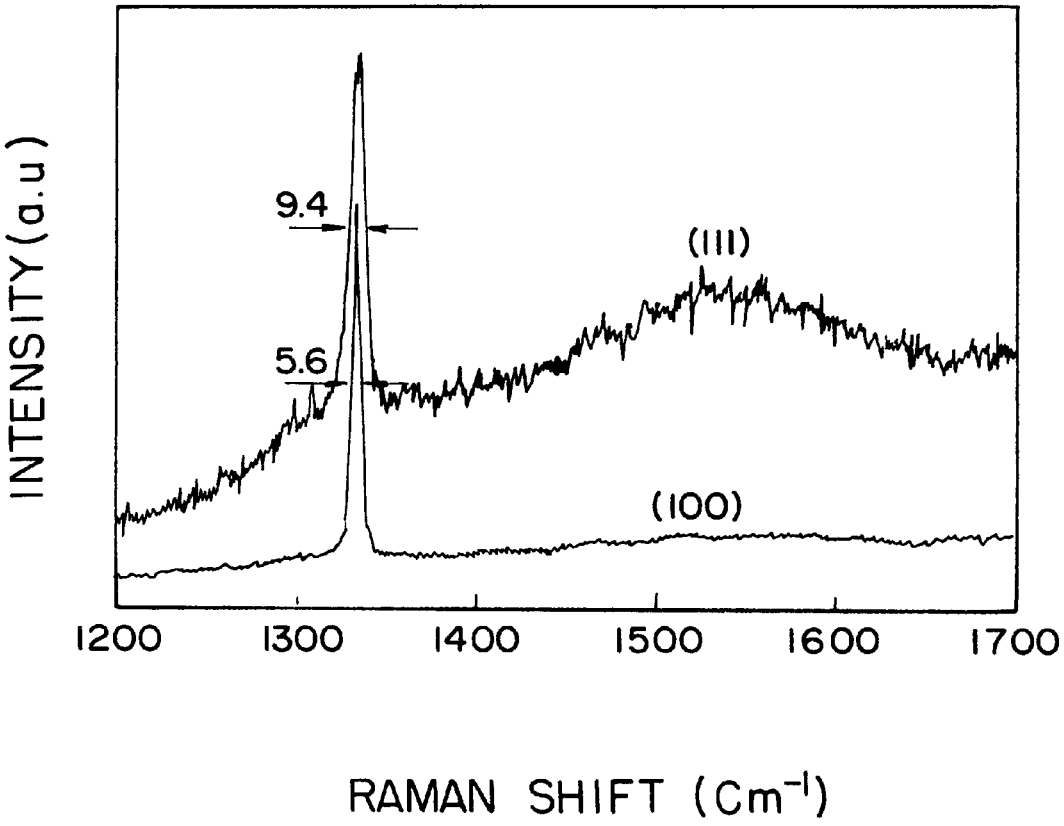
FIG. 2 is a plot graph showing the micro Raman spectra measured at the (100) and (111) growth phases of FIGS. 1A and 1B.

FIG. 2 shows the Raman spectra measured by a minute probe on (100) facets and (111) facets of a diamond film having the same surface structure as in FIG. 1A, which spectra show a much smaller FWHM(Full Width at Half Maximum) and intensity of humps around 1500 $cm^{-1}$ for the film formed diamond behind the (100) facets than behind the (111) facets.

Since diamond has a severe vulnerability to oxygen-containing gas at a high temperature, diamond can be etched using an oxygen-containing gas. The etching process in accordance with the present invention is effected by plasma-processing a diamond film employing an oxygen-containing gas.

Any gas being used for diamond etching in general can be adopted for the etching process in accordance with the present invention, and the gas is adopted according to its etching speed and etching selectivity. Oxygen-containing gas is advantageous in the etching, and inert gases such as hydrogen and argon or gases containing air or nitrogen can be added thereto. It should be borne in mind that the gases selected can effect the field emitter characteristics due to the consequent change in the diamond field emitter surface property.

When pure oxygen or oxygen-argon was used, etching speed was somewhat increased relatively compared to using air, and when using oxygen-hydrogen etching speed was decreased according to the hydrogen density increase. When the specimen temperature was low, the etching speed was decreased, and the etching uniformity was decreased according to the gas pressure increase.

Etching condition is not limited, however, an etching speed which can differentiate each growth facet in accordance with different defect densities is selected. Such etching speed will vary depending upon the selected gas, etching pressure and specimen temperature.

Due to the defects contained in diamond having an $sp^2$ graphite structure, etching anisotropy caused by defect density can be expected during diamond etching. According to the present invention, diamond grown behind (111) facets enables much easier etching than that grown behind low defect density (100) facets, so that when etching columnar texture diamond, the diamond formed behind the high defect density (111) facets is first etched, and thus the diamond formed behind the (100) facets remains of a columnar type.

Figure 4:
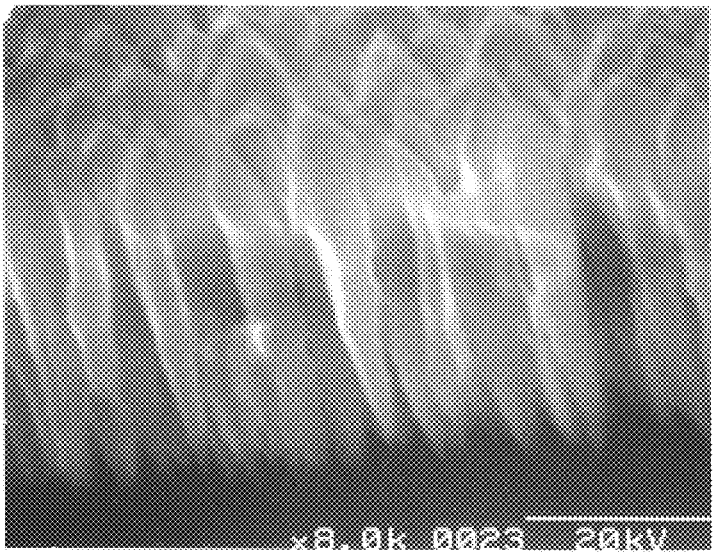
FIG. 4 is a cross-sectional micrographic view showing the texture obtained after etching in an air plasma the specimen in FIGS. 1A and 1B.
Figure 5A:
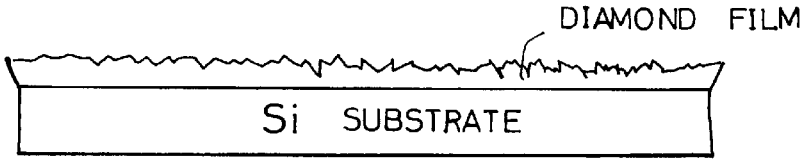
FIGS. 5A through 5D are views showing a diamond tip fabrication method in accordance with the present invention.
Figure 5B:
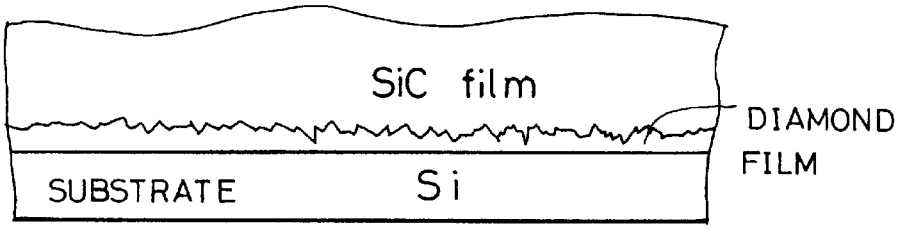
Figure 5C:
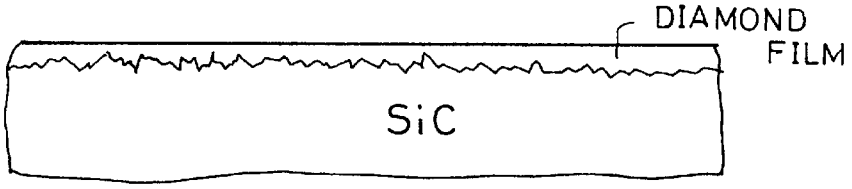
Figure 5D:
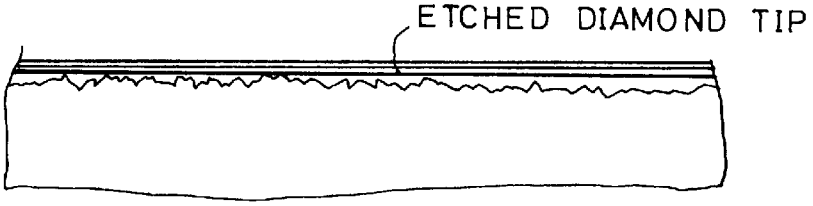

The FIG. 1A diamond film structure is formed into that of FIG. 4 when etched by an anisotropic etching process. The lower portion of the structure in FIG. 4 is contacted to a substrate, and the upper portion thereof is equal to the growth facets. Diamond etching begins from the particle interfaces thereof thus to form pointed shapes. With the etching being continued, pointed apex tips are formed at the upper and lower end portions.

When diamond is etched in accordance with the present invention, high curvature tips are formed at the substrate side portions and growth facet side portions. As a result, a more improved electron emission effect than that of a substrate diamond emitter can be obtained.

However, since the lower portions of the diamond tips are formed into a pointed pattern having a high curvature, it is much more efficient to utilize the lower portion as a field emitter.

The high curvature diamond field emitter tip fabrication method includes forming on a substrate a diamond film composed of square (100) facets and (111) facets distributed thereabout and columnar diamond particles having defect density differences between the diamond being formed beneath the (100) and (111) diamond growth facets, and etching the diamond film using an oxygen-containing gas plasma.

Further, the high curvature diamond field emitter tip fabrication method in accordance with the present invention includes forming on a substrate a diamond film composed of square (100) facets and (111) facets distributed thereabout and columnar diamond particles having defect density differences between the diamond being formed beneath the (100) and (111) diamond growth facets, forming a supporting film on the diamond film, removing the substrate therefrom, and etching the diamond film using an oxygen-containing gas plasma after one of the previously described steps.

The fabrication steps for using the lower portion of the diamond film to which an Si substrate is connected are as follows.

The first step is to form on a substrate a diamond film composed of columnar particles and (100) square facets and (111) facets distributed thereabout having diamond defect densities which are different between the diamond formed behind the (100) growth facets and that formed behind the (111) diamond growth facets.

The second step is to deposit a supporting film having a thickness of several hundred μm to 1 mm on the diamond film by means of a chemical deposition method. The supporting thin film deposition on the diamond growth facets is in order to support the diamond film when detaching the Si substrate therefrom in order to expose and utilize the diamond film lower portion adjacent to the substrate. Any material suitable for a supporting thin film which retains stability during the substrate removal process, remains stable in a high temperature oxygen atmosphere for etching diamond, has electrical conductivity, and which causes no wiring problems in manufacturing displays afterwards, can be adopted.

Acid is commonly employed to remove the widely used Si substrate, so that a silicide, or carbonate such as SiC and TiC can be adopted for the supporting thin film because materials such as silicide and carbonate facilitate Si substrate removal due to their stability under acid. In addition, SiC can be used as a proper conductive material in accordance with its electrical conductivity.

Substrate removal steps can vary depending upon the employed substrate. Acid solutions such as nitric-acid, or a halogenic-acid are generally adopted for a Si substrate removal.

The step for etching the diamond film using an oxygen-containing plasma is performed as described above, and at the end of any one of the above-described three fabrication steps, etching can be effected. That is to say, when the etching process occurs prior to the substrate removal, the lower diamond film portion adjacent to the substrate is subsequently formed into a desired high curvature diamond tip. However, when etching is performed after the substrate removal, since the lower diamond film portion adjacent to the substrate is etched into a desired high curvature type, the etching process after the third step is recommended.

Meanwhile, when oxygen is absorbed into a diamond surface, the emission property thereof becomes poorer, and when an oxygen-containing gas is employed in the etching process, a considerable thickness of graphite layer exists on the diamond surface, so that it is recommended to remove the oxygen and the graphite layer. Also, it is desired to make a specimen process in a hydrogen plasma after the etching process.

The diamond field emitter fabricating method in accordance with the present invention will now be specified hereunder, however, the specific examples given should be understood not to limit the present invention.

EXAMPLE 1

Columnar Textured Diamond Film Synthetic Process

To form surface texture square diamond (100) facets, three methods were used to synthesize a diamond film.

AA. Thermal Filament Chemical Vapor Deposition Method

A 20 μm thick diamond film having a (100) diamond surface texture was formed on a substrate under the condition of (100) surface shape being exhibited/manifested, by changing the addition amount of oxygen introduced into a hydro-methane mixed gas employing a thermal filament chemical vapor deposition. The deposition temperature and the tungsten filament temperature for gas activation were set at 900° C. and 2000° respectively. The methane gas concentration was fixed at 1.6%. Synthetic pressure was 40 mbar and the entire influx was 100 sccm. The addition amount of oxygen was increased to 0.8% under such conditions. The synthesized diamond surface was composed of square (100) facets up to 0.3% of the entire added oxygen therein. When the oxygen amount increases, the angle between a (100) facet and the substrate increases, so that only a part of the (100) facets was exposed on the texture surface, and when the oxygen addition ranges were between 0.1% and 0.3%, the surface type in accordance with the present invention was obtained. Such oxygen addition range varies depending upon the methane concentration and the deposition temperature; as the methane concentration is increased, the more usable the oxygen concentration becomes, and the lower the temperature, the oxygen range is broadened.

BB. Microwave PACVD method (1)

A 20 μm thick diamond film having (100) type surface texture was formed on a substrate while changing the deposition temperature by means of a PACVD(Plasma Assisted Chemical Vapor Deposition). A 1% methane gas was used, with the entire influx being 100 sccm, using a pressure of 40 torr. The experiment was done at the substrate temperature 770° C. to 1050°. The temperature range depends upon the methane concentration, and as the methane concentration increases, the temperature range is widened.

CC. Microwave PACVD method (2)

A 20 μm thick diamond film having (100) type surface texture was formed on an Si substrate while changing the methane concentration, the pressure being 90 torr, gas influx being 100 sccm, and the deposition temperature being at 880° C., and a (100) type surface texture was obtained under 4% methane composition.

EXAMPLE 2

Diamond Etching Process

The diamond film which was synthesized in Example 1 was etched using a plasma. The plasma which is formed using microwaves and used for etching was that employed to synthesize the diamond. Air was used for the gas when the plasma was formed, and the diamond was etched as follows.

Figure 3:
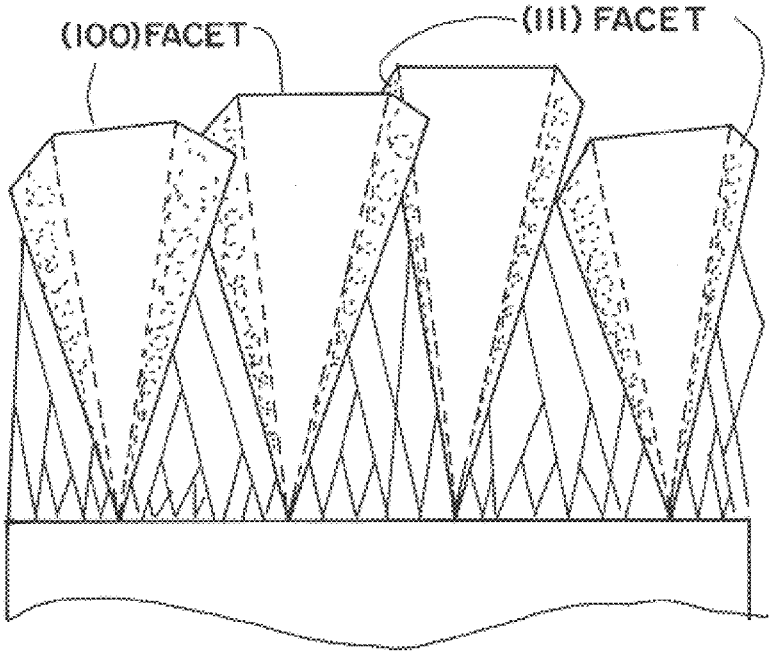
FIG. 3 is a view showing the (100) oriented diamond film defect distribution.

A specimen was placed on an alumina support with the plasma output being 120 W, the gas pressure being 20 torr, and the temperature being 700° C., and the etching thereof was observed. As time passed, the etching started from the surface portion of the diamond film, and the diamond portion beneath the (111) facets which surround the (100) facets was first etched into a pyramid shape as shown in the upper portion of FIG. 4, and then into a high curvature texture as shown in FIG. 3 after the etching had proceeded for thirty minutes. When the specimen temperature was lower than 700° C., the etching showed a significant decrease in speed. Also, if the pressure which influences the etching uniformity is increased, the etching uniformity is decreased. The proper pressure in the above conditions was regarded as less than 20 torr.

EXAMPLE 3

Diamond Tip Fabrication having SiC Supporting Thin Film

A 500 μm thick SiC thin film was deposited, using a chemical vapor deposition, on the diamond film formed on the Si substrate as in Example 1. During the SiC supporting thin film deposition, the pressure and the influx were 20 torr and 1250 sccm respectively, and the temperature was 1150° C. A mixed gas of $CH_3SiCl_3$ and hydrogen was adopted for the deposition gas.

The specimen on which SiC thin film was deposited was immersed in a mixture of nitric acid and fluoric acid to dissolve out the Si substrate, so that the diamond film portion which was formerly connected to the Si substrate could be exposed. The specimen was etched using an oxygen-containing plasma as shown in Example 2. The etched specimen exhibited the high curvature diamond tip texture being upwardly arrayed on the SiC substrate.

What is claimed is:

1. A high curvature diamond field emitter tip fabrication method comprising:

forming on a substrate a diamond film composed of square (100) phase-oriented facets and (111) phase-oriented facets distributed thereabout and columnar diamond particles having defect density differences between the diamond formed beneath the (100) and (111) diamond growth facets, and etching said diamond film using an oxygen-containing gas plasma.

2. A high curvature diamond field emitter tip fabrication method comprising:

forming on a substrate a diamond film composed of square (100) phase-oriented facets and (111) phase-oriented facets distributed thereabout and columnar diamond particles having defect density differences between the diamond formed beneath the (100) and (111) diamond growth facets;

forming a supporting film on said diamond film;

removing said substrate therefrom; and etching said diamond film using an oxygen-containing gas plasma after any one of the preceding steps.

3. The high curvature diamond field emitter tip fabrication method of claim 1, wherein said diamond film is formed by one of a thermal filament chemical vapor deposition and a microwave plasma assisted chemical vapor deposition.

4. The high curvature diamond field emitter tip fabrication method of claim 2, wherein said etching is performed after removing said substrate.

5. The high curvature diamond field emitter tip fabrication method of claim 2, wherein the temperature during said etching is maintained at higher than 700°.

6. The high curvature diamond field emitter tip fabrication method of claim 2, wherein the etched diamond tip is subsequently treated with a hydrogen plasma.

7. The high curvature diamond field emitter tip fabrication method of claim 2, wherein said supporting film consists of one of SiC, TiC and a silicide compound.

* * * * *